US005181635A

United States Patent [19]

Balderrama et al.

[11] Patent Number: 5,181,635

[45] Date of Patent: Jan. 26, 1993

[54] LIQUID PUMP DISPENSER HAVING A STATIONARY SPOUT

[75] Inventors: Mark A. Balderrama, Colton; R. P. Grogan, Downey, both of Calif.

[73] Assignee: Calmar Inc., Industry, Calif.

[21] Appl. No.: 708,377

[22] Filed: May 31, 1991

[51] Int. Cl.[5] ..... B65D 5/40

[52] U.S. Cl. ..... 222/383; 222/341; 222/484; 239/333

[58] Field of Search ..... 222/321, 340, 341, 380, 222/383, 385, 484; 239/333

[56] References Cited

U.S. PATENT DOCUMENTS

| | | | |
|---|---|---|---|
| 3,759,426 | 9/1973 | Kane et al. | 222/385 |
| 4,046,292 | 9/1977 | Corsette | 222/383 |
| 4,050,613 | 9/1977 | Corsette | 222/383 X |
| 4,218,198 | 8/1980 | Kutick et al. | 222/383 X |
| 4,225,063 | 9/1980 | Ayres | 222/380 |
| 4,227,628 | 10/1980 | Parsons | 222/383 X |
| 4,396,132 | 8/1983 | Christensen | 222/380 X |
| 4,402,432 | 9/1983 | Corsette | 222/380 X |
| 4,410,107 | 10/1983 | Corsette | 222/380 X |
| 4,618,007 | 10/1986 | Corsette | 222/383 |
| 4,747,523 | 5/1988 | Dobbs | 222/383 |

*Primary Examiner*—Kevin P. Shaver

*Attorney, Agent, or Firm*—Watson, Cole, Grindle & Watson

[57] ABSTRACT

A liquid pump dispenser has a stationary spout, a fixed piston and a reciprocating cylinder therewith defining a variable volume pump chamber. The dispenser has container venting and pump priming features, and includes an inlet/discharge valve housing. The dispenser has a reduced number of parts for simplicity and economy.

7 Claims, 1 Drawing Sheet

LIQUID PUMP DISPENSER HAVING A STATIONARY SPOUT

BACKGROUND OF THE INVENTION

This invention relates to a liquid pump dispenser having a minimum of constituent parts and including a stationary spout, a stationary piston, container venting and pump priming features, and an inlet/discharge valve housing. More particularly, such dispenser is of the throttle pump variety having a positive leakproof vent control.

Known is a liquid pump dispenser disclosed in U.S. Pat. No. 4,402,432 having a pump priming feature and a positive container vent control for a pump of the pressure built-up variety having a reciprocable plunger defining a variable volume pump chamber with a fixed piston, and requiring a plunger head slidable relative to the plunger for controlling the discharge in response to accumulation of pressure within the pump chamber. The discharge passage reciprocates with the plunger head.

Also known is a pump dispenser from U.S. Pat. No. 4,218,198 which has a stationary spout and a fixed pump cylinder for the reception of a reciprocating piston. A circular discharge flap valve is located between the pump chamber and the discharge passage, and a separate vent seal defining a passive vent is provided.

It is desirable to provide an improved pump dispenser of the throttle variety having a minimum number of parts for economy and simplicity yet avoiding the performance and operational drawbacks of the known pump structures.

SUMMARY OF THE INVENTION

It is therefore an object of the present invention to provide a liquid dispenser of the throttle pump variety having a minimum number of parts rendering the pump structure easy and economical to fabricate and assemble, simple to operate yet highly reliable in dispensing liquid product without leakage.

Another object is to provide such a pump dispenser as having a stationary spout and fixed piston, a positive container vent control, and inlet and discharge valving within the pump body.

A further object is to provide such a pump dispenser as having a pump chamber priming feature, and a combined inlet valve and discharge valve housing located within the valve body for defining the valve control inlet and the discharge valving.

Other objects, advantages and novel features of the invention will become more apparent from the following detailed description of the invention when taken into conjunction with the accompanying drawings.

DETAILED DESCRIPTION OF THE INVENTION

Figure 1:
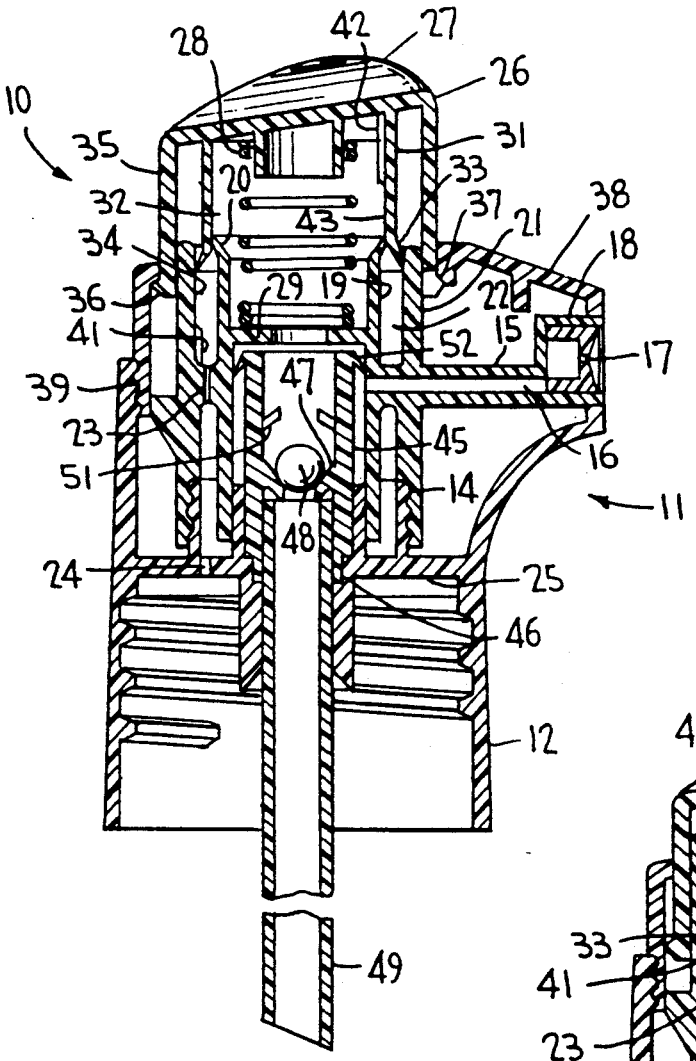
FIG. 1 is a vertical sectional view of the liquid pump dispenser according to the invention.
Figure 2:
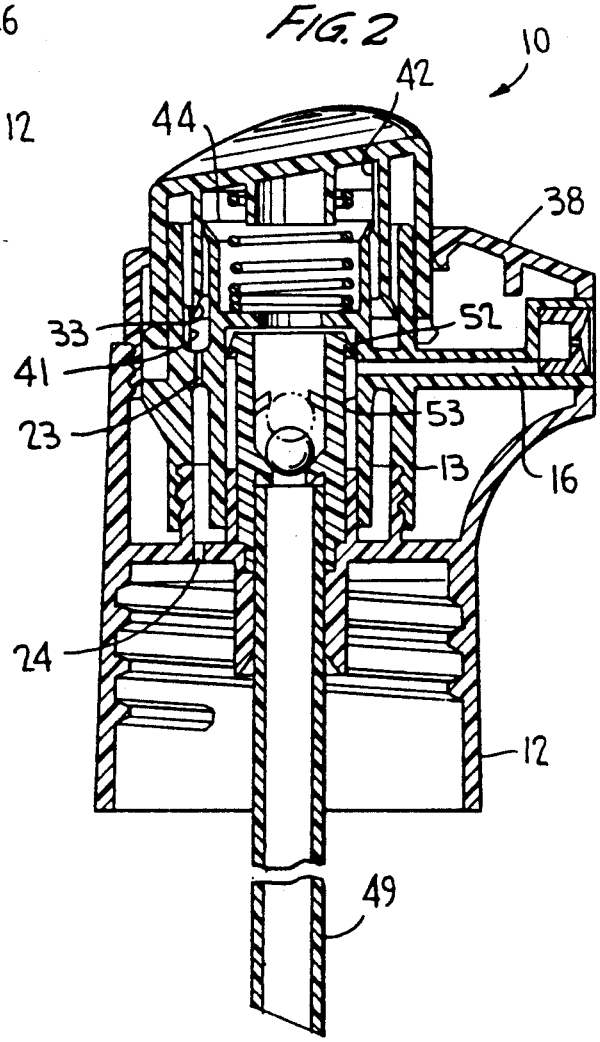
FIG. 2 is a view similar to FIG. 1 showing the plunger head depressed during pump operation.

Turning now to the drawings wherein like reference characters refer to like and corresponding parts throughout the several views, the pump dispenser according to the invention is generally designated 10 in FIGS. 1 and 2 and is of the throttle pump variety given that once primed, product under pressure is discharged from the pump chamber upon plunger reciprocation via an open discharge valve without reliance on pressure build-up causing plunger shifting to open the discharge.

The dispenser comprises a pump body 11 which includes a closure cap 12 for threading onto the neck of a container (not shown) of flowable product to be dispensed. The cap may, of course, be otherwise snapped into place onto the container neck.

The pump body further includes a part 13 fixed as at 14 to the closure cap and having a transversely extending stationary spout 15 defining a discharge passage 16 terminating in a discharge orifice 17 located in a conventional orifice cup 18.

Part 13 further includes a fixed upstanding piston 19, and a surrounding annular sleeve 21 spaced from the piston to therewith define an annular vent chamber 22. The vent chamber communicates with the interior of the container via a vent opening 23 located in part 13 and a vent opening 24 located in transverse wall 25 of the closure cap.

A plunger head 26 has a finger engageable crown 27 and is mounted on part 13 for axial reciprocation against the force of a coil return spring 28 extending between the underside of crown 27 and a transverse wall 29 of part 13.

The plunger has a depending plunger skirt 31 sealingly mounted on piston seal 20 of the piston for therewith defining a variable volume pump chamber 32. The plunger skirt terminates in an annular deformable vent seal 33 in sealing engagement with inner wall 34 of sleeve 21. And, the plunger has an outer skirt 35 terminating in a stop shoulder or rib 36 cooperating with a mating stop shoulder or rib 37 on a shroud cover 38 fixed to the pump body as at 39. Upward movement of the plunger head is therefore positively limited by the interengagement of ribs 36 and 37 which are designed not to sealingly engage but to provide communication between the atmosphere and the underside of the plunger head.

Vent chamber 22, when opened, communicates with the atmosphere via ribs 36 and 37. In the at rest position of the plunger shown in FIG. 1, and at the commencement of the pumping operation, vent seal 33 sealingly engages wall 34 of sleeve 21. Upon continued downward movement of the plunger head by the operator, vent seal 33 contacts a vent rib 41 located on wall 34 near the bottom of the vent chamber. Upon such contact the vent seal is deformed inwardly such that its seal with wall 34 is broken, thereby opening the vent chamber from the atmoshpere into the interior of the container to thereby replenish the dispensed product with air to avoid hydraulic lock and container collapse during the pump pressure stroke.

And, a priming rib 42 is located on inner wall 43 of plunger skirt 31 near the upper end thereof. Any accummulated air in pump chamber 28 is thus expelled during the initial downstroke or downstrokes of the plunger as priming rib 42 contacts resilient piston seal 20 on the piston thereby causing the piston seal to deform to establish communication with vent chamber 22. In this condition, shown in FIG. 2, vent seal 33 is deformed by vent rib 41 such that any unwanted air is purged from the pump chamber either to the atmosphere via the vent chamber or into the container via vent openings 23 and 24.

A combined inlet and discharge valve housing 45 is disposed within the pump body and is connected to wall 25 as at 46. The housing includes an inlet valve seat 47 and an inlet ball check valve 48 engaging the seat. The housing suspends a dip tube 49 extending into the container, and has tiny projections 51 defining a ball cage for the inlet valve.

Located between the pump chamber and discharge passage 16 is a discharge valve 52 in the form of a deformable annular valve seal in sealing engagement with a circular valve seat 53 defining an inner wall of the pump body into which discharge passage 16 terminates. The discharge valve may be secured to or otherwise made integral with housing 45 and may be located at or near the upper end of the housing. The discharge valve seal inwardly deforms radially in response to an increase in pressure within the pump chamber during plunger reciprocation to thereby open the discharge for expelling product under pressure through the discharge passage.

Operation of the present dispenser is made manifest by the foregoing detailed description. Product is dispensed in a lateral direction during each pressure stroke as the plunger is manually depressed. To initially prime the pump, the plunger is depressed until the priming rib deforms the piston seal to purge the pump chamber of any unwanted air to the atmosphere and/or into the container via the open vent. The container vent is opened at the end of each plunger stroke as the vent seal on the plunger skirt is deformed by the vent rib thereby opening the interial of the container to the atmosphere. Otherwise, in non-use conditions of storage and shipping, the vent chamber is sealed closed to avoid leakage through the vent openings. The vent chamber remains sealed closed at the initiation of the plunger downstroke, such that should the plunger be inadvertently nudged or the dispenser dropped against the hard surface, any slight movement of the plunger head will not cause the vent seal to break open.

Although a vent rib is disclosed as a means for breaking the vent seal, other means could be provided within the scope of the invention. For example, a vent groove could be provided, a vent opening could be devised such that the vent seal is caused to slide therealong, or the lower end of wall 34 could have an enlarged diameter.

Likewise, a vent groove could be substituted for priming rib 42 without departing from the invention. And inlet valves other than a ball check valve could be provided within the scope of the invention.

Obviously, many other modifications and variations of the invention are made possible in light of the above teachings. It is therefore to be understood that within the scope of the appended claims the invention may be practiced otherwise than as specifically described.

What is claimed is:

1. A liquid pump dispenser comprising, a pump body mountable in a fluid tight manner on a container of flowable product to be dispensed, an upstanding stationary pump piston on said body, a valve controlled inlet within said body, a manually reciprocable spring biased plunger head having a plunger skirt in sealing engagement with said piston for therewith defining a variable volume pump chamber, a stationary spout on said pump body defining a discharge passage extending from said pump chamber, a discharge valve acting between said pump chamber and said discharge passage, an annular sleeve on said body surrounding said piston in spaced relationship and therewith defining a vent chamber openable to the atmosphere, said body having means defining a vent passage extending from said vent chamber into the container, an annular vent seal on said plunger skirt in sealing engagement with an inner wall of said sleeve for sealing said vent chamber closed in an upper position of said plunger head relative to said piston, and means on said inner wall for breaking the sealing engagement between said vent seal and said inner wall in a lowered position of said plunger head relative to said piston for venting the interior of the container to atmosphere.

2. The dispenser according to claim 1, further comprising means on an inner wall of said plunger skirt for breaking the sealing engagement of said plunger skirt with said piston in the lowered position of said plunger head for establishing communication between said pump chamber and said vent chamber for expelling any unwanted air from said pump chamber during plunger head reciprocation.

3. The dispenser according to claim 1, wherein said body has a circular valve seat between said pump chamber and said discharge passage, said discharge valve comprising a deformable annular valve seal in sealing engagement with said seat and deforming radially away from said seat in response to an increase in pressure within said pump chamber.

4. The dispenser according to claim 1, wherein said means on said inner wall of said sleeve comprises a vent rib for deforming said skirt vent seal.

5. The dispenser according to claim 2, wherein said position has a piston seal and wherein said means on said inner wall of said skirt comprises a priming rib for deforming said piston seal.

6. The dispenser according to claim 1, wherein a combined inlet valve and discharge valve housing is disposed within said valve body for defining said valve controlled inlet and said discharge valve.

7. The dispenser according to claim 6, wherein said body has a circular valve seat between said pump chamber and said discharge passage, said discharge valve comprising a deformable annular valve seal on said housing, said valve seal being in sealing engagement with said seat and deforming radially away from said seat in response to an increase in pressure within said pump chamber.

* * * * *